US006026259A

United States Patent [19]

Yamaki et al.

[11] Patent Number: 6,026,259

[45] Date of Patent: Feb. 15, 2000

[54] CONTACT-TYPE ERASING DEVICE FOR IMAGE FORMING APPARATUS

[75] Inventors: Hideo Yamaki; Koji Niizawa; Hiroshi Murasaki, all of Toyokawa, Japan

[73] Assignee: Minolta Co., Ltd., Osaka, Japan

[21] Appl. No.: 08/997,392

[22] Filed: Dec. 23, 1997

[30] Foreign Application Priority Data

| | | | |
|---|---|---|---|
| Dec. 26, 1996 | [JP] | Japan | 8-347377 |
| Dec. 27, 1996 | [JP] | Japan | 8-350793 |
| Dec. 27, 1996 | [JP] | Japan | 8-350798 |

[51] Int. Cl.[7] ..... G03G 15/00

[52] U.S. Cl. ..... 399/128; 361/225; 399/26

[58] Field of Search ..... 399/128, 169, 399/168, 170, 172, 174, 115, 26, 31, 43, 50; 361/225; 250/324, 325, 326

[56] References Cited

U.S. PATENT DOCUMENTS

| | | | |
|---|---|---|---|
| 4,351,603 | 9/1982 | Tagawa | 250/324 X |
| 5,003,350 | 3/1991 | Yui et al. | 399/43 |
| 5,159,388 | 10/1992 | Yoshiyama et al. | 399/26 |
| 5,278,612 | 1/1994 | Inui | 399/26 |
| 5,634,179 | 5/1997 | Umeda et al. | 399/174 |
| 5,729,799 | 3/1998 | Numao et al. | 399/128 |
| 5,778,279 | 7/1998 | Kawai et al. | 399/26 X |

FOREIGN PATENT DOCUMENTS

| | | |
|---|---|---|
| 61-112366 U | 7/1986 | Japan . |
| 61-251887 | 8/1986 | Japan . |

*Primary Examiner*—Arthur T. Grimley
*Assistant Examiner*—Sophia S. Chen
*Attorney, Agent, or Firm*—McDermott, Will & Emery

[57] ABSTRACT

An erasing device includes a sheet-like erasing member. The erasing member is supported by an electric charger in contact with the image bearing member for erasing a residual electric charge from the image bearing member. Preferably, the erasing member is supported by a supporting member which in turn is supported by the electric charger. Therefore, the erasing member can be disposed relative to the image bearing member with a greater precision without using any additional rigid member. Also, the image bearing member can be erased without any defect, which results in that the image bearing member is uniformly charged in the subsequent charging.

25 Claims, 7 Drawing Sheets

CONTACT-TYPE ERASING DEVICE FOR IMAGE FORMING APPARATUS

RELATED APPLICATIONS

The present invention is based on Japanese Patent Applications Nos. 8-347,377, 8-350,793 and 8-350,798, each content of which being incorporated by reference.

FIELD OF THE INVENTION

The present invention relates to an erasing device for erasing an electric charge that remains on an image bearing member even after the image bearing member has been deprived of visualized images for use with an electrophotographic image forming apparatus and, more particularly, to an erasing device which includes a sheet-like erasing member that is disposed in close contact with the image bearing member for erasing the residual electric charge therefrom.

BACKGROUND OF THE INVENTION

In a conventional electrophotographic image forming apparatus, after transferring a toner image that is formed on an image bearing member or photosensitive drum onto a sheet substrate, an electric charge which still remains on the photosensitive drum should be erased in preparation for a subsequent image forming. For this purpose, there has been proposed an erasing device in which a flexible sheet made of electrically conductive material is mounted in the vicinity of the photosensitive member in contact at one plain surface thereof. With the erasing device, applying a certain voltage to the flexible sheet will erase the residual electric charge from the photosensitive drum.

Generally, the photosensitive drum has a length of about 300 to 400 mm. Therefore, to arrange the flexible sheet along the entire length of the photosensitive drum and bring the same into close contact therewith, a support member that has a considerable rigidity should be disposed in parallel to the photosensitive drum for supporting the flexible sheet. This rigid support member must be bulky and therefore occupies a larger installation space in the vicinity of the photosensitive drum, which in turn forces other devices arrange around the photosensitive drum to be smaller.

Unexamined Japanese Utility-Model Publication No. 61-112,366 discloses an erasing device that includes an erasing blade or erasing plate made of electrically conductive rubber. The erasing plate is disposed in the vicinity of the photosensitive drum while a longitudinal edge thereof is kept in contact with the outer periphery of the photosensitive drum for erasing the residual charge from the photosensitive drum.

For the erasing device that employs such erasing member, it is preferable that the erasing member is arranged so that it contacts only at the longitudinal edge thereof whether the erasing plate is thick or thin.

This is because keeping a major surface of the erasing sheet member in face-to-face contact with the photosensitive drum rather than the line contact tends to lead a variation of position where an electric discharge occurs between the erasing plate and the photosensitive drum due to the application of a certain voltage with the erasing plate, which will fail to erase the residual charge to a necessary extent depending upon the location.

Also, biasing the erasing plate to the photosensitive drum will lead a permanent set of the erasing member at a contact portion thereof and then increase a contact area of between the erasing member and the photosensitive drum, which results in an erasing defect on the photosensitive drum.

Further, for the contact-type erasing device as described above, it can be considered that the erasing is a sort of discharging in which an electric charge leaks from erasing device to the photosensitive drum. Therefore, keeping the erasing ability of the erasing device constant will lead an over-erasion of the photosensitive drum, which results in an adverse charge memory corresponding to the reproduced image.

SUMMARY OF THE INVENTION

Accordingly, an object of the present invention is to provide an erasing device that is smaller in size and capable of providing the sheet-like erasing member with uniform contact with the image bearing member along a longitudinal direction of the thereof.

Another object of the present invention is to provide an erasing device and a sheet-like erasing member, which is capable of providing a longitudinal edge of the sheet-like erasing member with a uniform line-contact with the image bearing member.

Another object of the present invention is to provide an erasing device which is capable of erasing the charge on the image bearing member free from an excess erasion that results in an erasion memory even when a thickness of an image bearing layer of the image bearing member has decreased in thickness.

Accordingly, an erasing device of present invention includes a sheet-like erasing member arranged in contact with an image bearing member for erasing a residual electric charge from said image bearing member. The erasing member is supported by an electric charger for charging the image bearing member.

Preferably, the erasing member is supported by a supporting member which in turn is supported by the electric charger.

When the electric charger is a corona charger, the supporting member and/or sheet-like erasing member is formed with an opening so that ozone which is generated in the vicinity of the corona charger can escape through the opening.

According to the erasing device, because the sheet-like erasing member is supported by the charger which is disposed along the image bearing member, the sheet-like erasing member can be disposed against the image bearing member with a greater precision without using any additional rigid member. Also, the image bearing member can be erased without any defect, which results in that the image bearing member is uniformly charged in the subsequent charging. Further, the openings of the support member and the sheet-like erasing member allows ozone to flow out therethrough. This prevents a surface hardening of the erasing member which would occur when the erasing member is exposed to ozone, ensuring a stable erasing performance of the erasing member for a long time.

According to a second aspect of the invention, the erasing device includes a sheet-like erasing member which is arranged in contact with an image bearing member for erasing a residual electric charge on the image bearing member. The erasing member includes a first layer made of an electrically conductive material and a second layer located on one major surface of the first layer, and the erasing member is arranged so that the first layer is in contact with the image bearing member.

The erasing member is in the form of arch having a concave surface portion on one side and a convex surface portion on the opposite side, and the concave surface portion is formed by the first layer.

Also, a longitudinal edge of the first layer is in contact with the image bearing member.

Further, the erasing member is arranged on an upstream side and a downstream side of a cleaning member with respect to a direction along which the image bearing member moves. The erasing member which is arranged on the upstream side of the cleaning member is designed to capture developers that are erased from the image bearing member and then fall.

Preferably, the conductive first layer is applied with a voltage that is about 0.5 to 1.2 times greater than a threshold voltage that triggers an electric discharge between the first layer and the image bearing member.

According to the second aspect of the invention, the longitudinal edge of the first conductive layer, forming the concave surface portion, of the sheet-like erasing member will make a liner and stable contact with the image bearing member. Also, the sheet-like erasing member keeps its arched configuration so that the concave surface portion can always made the longitudinal edge thereof contact with the image bearing member.

Further, in the case that the sheet-like erasing member is arranged on upstream and downstream sides of the cleaning device, the developer which is scraped from the image bearing member can be captured by one erasing member disposed below the other, preventing the developer from scattering into its circumstance.

Furthermore, applying the conductive first layer with a voltage of about 0.5 to 1.2 times greater than a threshold voltage that triggers an electric discharge between the first layer and the image bearing member will prevent an over-erasion of the image bearing member.

According to the third aspect of the invention, the contact-type erasing device includes an erasing member which is in contact with the image bearing member for erasing the residual electric charge on the image bearing member, a voltage applying member which applies the erasing member with a voltage and a controller for controlling the voltage in response to a deterioration of the image bearing member.

In this third aspect of the present invention, an ability of the erasing device is decreased in proportion to a deterioration of the image bearing member.

In a modification of the third aspect of the invention, the erasing device is so designed that an ability erasing the residual charge thereof decreases in proportion to the deterioration of the image bearing member or the number of reproduced images thereby.

In another modification of the third aspect of the present invention, the erasing device includes a sheet-like erasing member which is disposed in contact with the image bearing member and a power source for applying a voltage to the sheet-like erasing member. The erasing device further includes a controller for controlling the voltage in accordance with the deterioration of the image bearing member.

In another modification of the third aspect of the present invention, the voltage Ve to be applied to the conductive erasing member is determined on the basis of the following equation:

$$0.5|Vth| \leqq Ve \leqq 1.2|Vth|$$

wherein Vth represents a threshold voltage difference that triggers the electric discharge between the erasing member.

According to the third aspect of the present invention, the ability of the erasing device is controlled in response to the deterioration of the image bearing member, preventing the over-erasion of the image bearing member which would form an erasing memory thereon. This ensures the image bearing member to be provided with a uniform charge in the subsequent charging process.

BRIEF DESCRIPTION OF THE DRAWINGS

A preferred embodiment of the invention is described below by referring to the drawings in which.

DETAILED DESCRIPTION OF THE PREFERRED EMBODIMENTS

Figure 1:
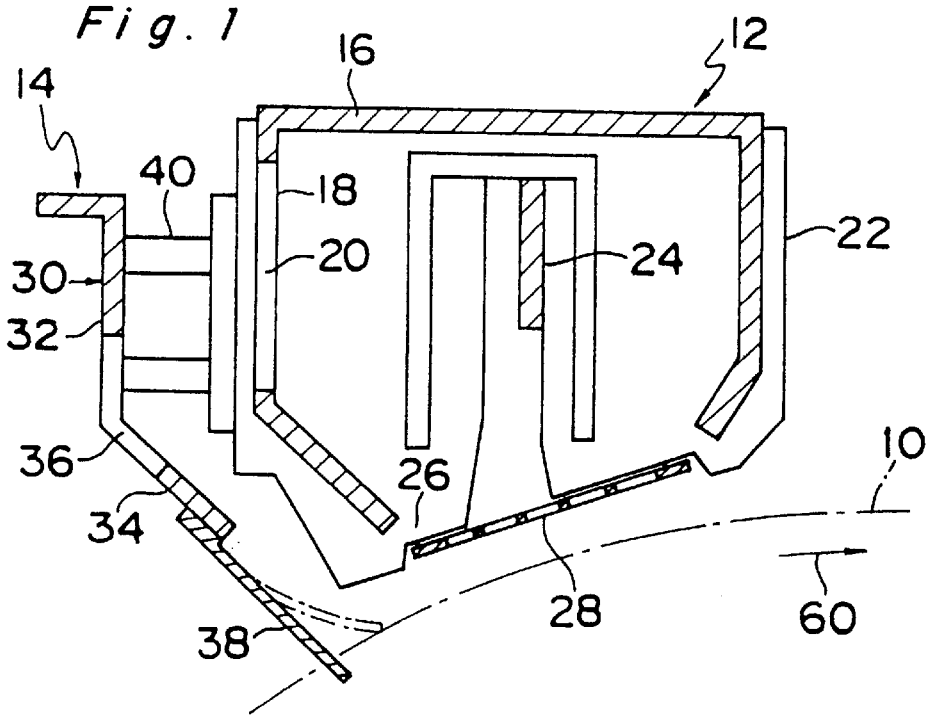
FIG. 1 is a cross-sectional view of an erasing device of the present invention and an electric charger which holds the erasing device.

With reference to the drawings, descriptions will be made to a first embodiment of the present invention. FIG. 1 shows a portion of an outer periphery surface of an image bearing member or photosensitive drum generally indicated by reference numeral 10 for use in an electrophotographic image forming apparatus such as copy machine and printer, an electric charger generally indicated by reference numeral 12 for providing the outer periphery surface of the photosensitive drum 10 with an electric charge of certain voltage, and an eraser generally indicated by reference numeral 14 for erasing a residual electric charge from the photosensitive drum 10 in preparation for the next image forming prior to the subsequent charging by the electric charger 12.

The electric charger 12 has a stabilizer 16 that extends along the substantial length of the photosensitive drum 10 in an axial direction thereof. Preferably, the stabilizer 16 is made from a metal plate and shaped in the form of bracket. The stabilizer 16 has a wall 18 adjacent to the eraser, in which a plurality of equally spaced openings 20 is formed in a line parallel to the axis of the photosensitive drum 10. Either of the opposite ends of the stabilizer 16 with respect to the axis of the photosensitive drum 10 is provided with a holder 22, preferably made of insulative synthetic resin, through which the stabilizer 16 is fixedly supported on a frame (not shown) of the image forming apparatus.

Within the stabilizer 16, an elongated electrode 24 is extended in the axial direction of the photosensitive drum 10 and supported at opposite ends thereof on the holders 22. In this embodiment, a strip-like electrode having a plurality of equally spaced protrusive portions in a longitudinal edge confronting to the photosensitive drum 10 is used for the electrode 24, although, it may be a wire conventionally employed in the electrophotographic image forming apparatus. An opening 26 of the stabilizer 16 confronting the photosensitive drum 10 is covered by a grid 28, illustrated in part in FIG. 3, which is also supported by the opposite holders 22.

Figure 2:
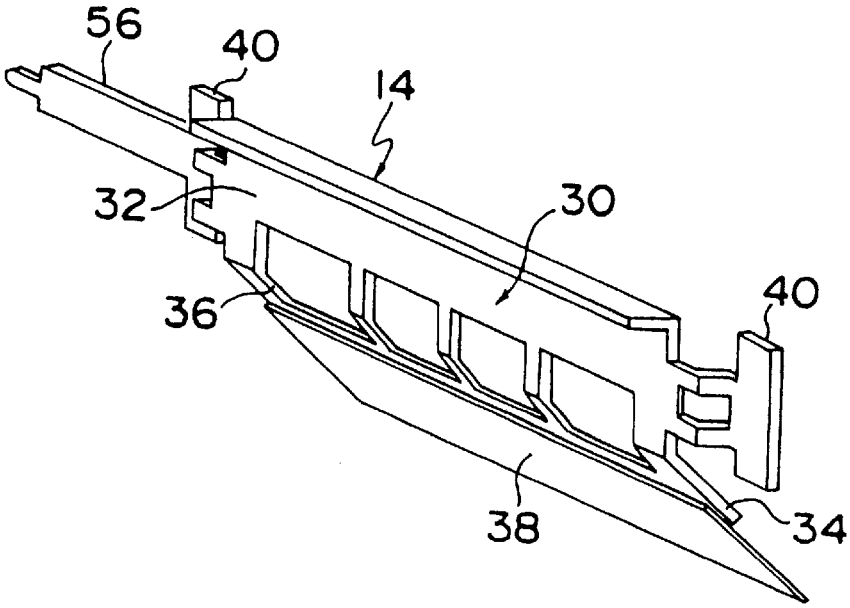
FIG. 2 is a perspective view of the erasing device of the present invention.

Referring to FIG. 2, the eraser 14 includes a support generally indicated by reference numeral 30, which extends along the substantial length of the photosensitive drum 10. Preferably, the support 30 is made from a single metal plate having a proximal portion 32 and a distal portion 34. Preferably, the distal portion 34 is angled relative to the proximal portion 32 and thereby directed to the photosensitive drum 10. The support 30 has a plurality of openings 36 equally spaced from each other in the axial direction of the photosensitive drum 10. Preferably, in this embodiment, each opening 36 extends in the proximal and distal portions 32 and 34.

A flexible erasing sheet 38 in the form of a strip, made of electrically conductive metal or synthetic resin having conductive particles therein, is supported along the longitudinal edge of the tip portion 34 by means of a suitable conductive adhesive or conductive tape so that the erasing sheet 38 is electrically connected with the support 30. Besides, the proximal portion 32 of the support 30 further includes legs 40 at opposite ends thereof.

The eraser 14 so constructed is releasably fixed on the holders 22 with the legs 40 being connected with the corresponding holders 22 by suitable means such as bolts.

Figure 3:
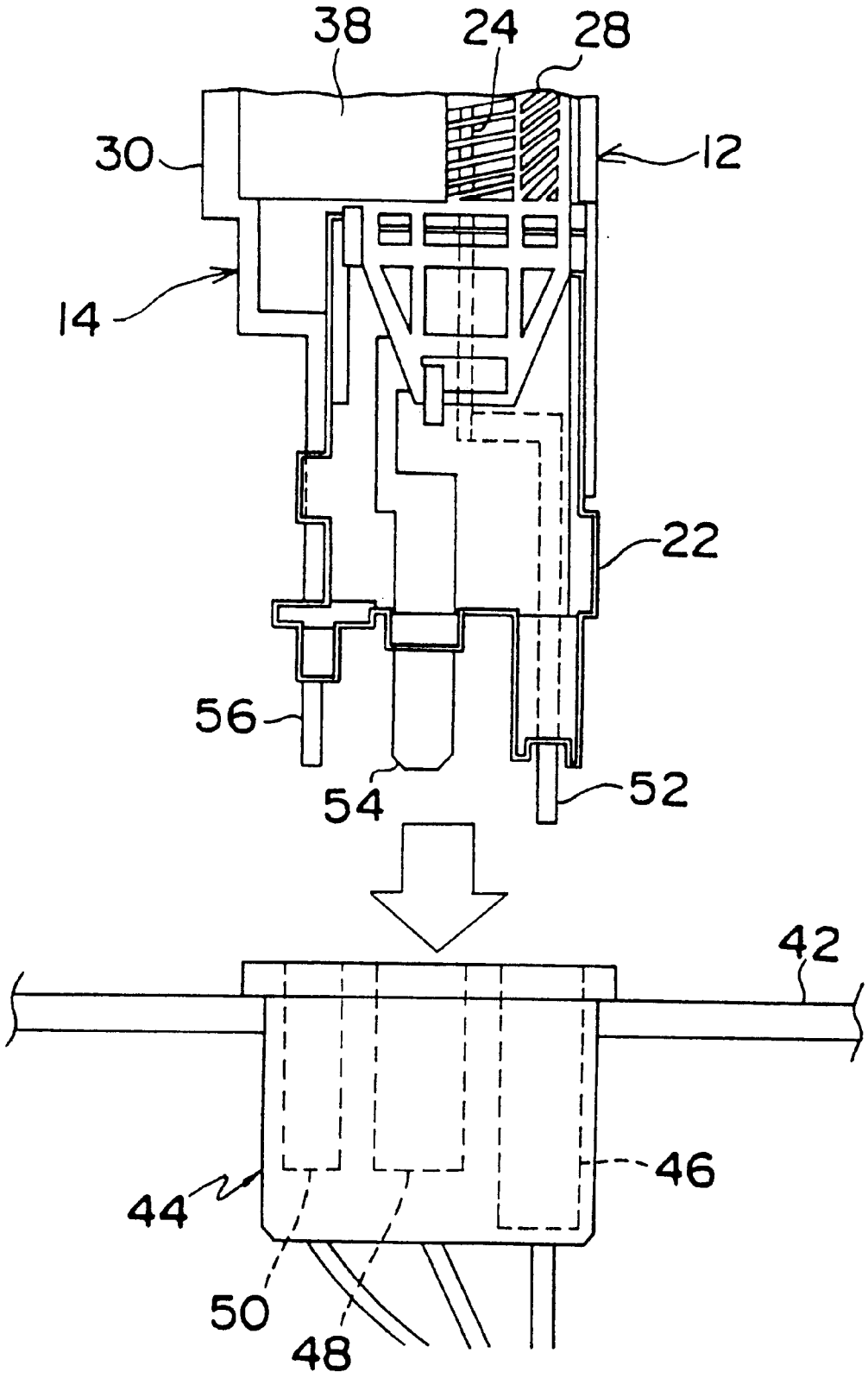
FIG. 3 is a bottom view which shows an electrical connection of the charger, erasing device and a body of an image forming apparatus.

Referring to FIG. 3, there is shown an electrical connection of the charger 12 and eraser 14 with a connector 44 of the image forming apparatus 42. The connector 44 includes three terminals 46, 48 and 50 for the electrode 24, grid 28 and eraser 14, respectively. The holder 22 of the charger 12, on the other hand, has transfer terminals 52 and 54 for electrodes 24 and 28, respectively. The transfer terminals 52 and 54 are projected in the longitudinal direction of the charger 12, allowing the terminals 52 and 54 to be connected with the electrode 24 and grid 28, respectively. Further, the holder 30 of the eraser 14 is formed at one end thereof with a transfer terminal 56 for erasing. Similar to the terminals 52 and 54, the terminal 56 is also projected from the holder 22. Thereby, the charger 12 and eraser 14 are fixed in the image forming apparatus 42 while the transfer terminals 52, 54 and 56 are electrically connected with the power supply terminals 46, 48 and 50, respectively.

For the charger 12 and eraser 14 so installed in the image forming device 42, respective voltages are supplied to the electrode 24, grid 28 and erasing sheet 38 from a power source (not shown) as the photosensitive drum 10 rotates in the direction indicated by reference numeral 60. This allows each incremental outer peripheral portion of the photosensitive drum 10 to bring into contact with the erasing sheet 38, erasing a residual charge which still remains after transfer of an image formed on the photosensitive drum 10 by a well-known electrophotographic image forming process onto a sheet member (e.g., paper). Then, each incremental portion of the photosensitive drum 10 is electrically charged by an electric discharge between the electrode 24 and the each incremental portion. An amount of electric charge charged by the electrode 24 is controlled by the grid 28, ensuring the photosensitive drum 10 to be charged with an aimed voltage. The erasing sheet 38 is supported through the holders 22 by the rigid charger 12, ensuring a uniform contact between the erasing sheet 38 and photosensitive drum 10 in the axial direction of the drum. This further results in a positive erasing of the residual charge at every surface portions of the photosensitive drum 10.

Disadvantageously, the electric charging of the electrode 24 decomposes oxygen in the vicinity thereof to generate unwanted ozone. The ozone is drawn into the opening 20 formed in the stabilizer 16 by an airflow generated by a suction unit (not shown) and then collected by the suction unit. Likewise, ozone that exists in the vicinity of the eraser 14 is drawn through the opening 36 in the support 30 into the suction unit. Therefore, no ozone remains in the vicinity of the erasing sheet 38. This will overcome the problem of surface hardening which would occur if the erasing sheet is made of synthetic resin and result in a reduction of durability thereof.

Figure 4A:
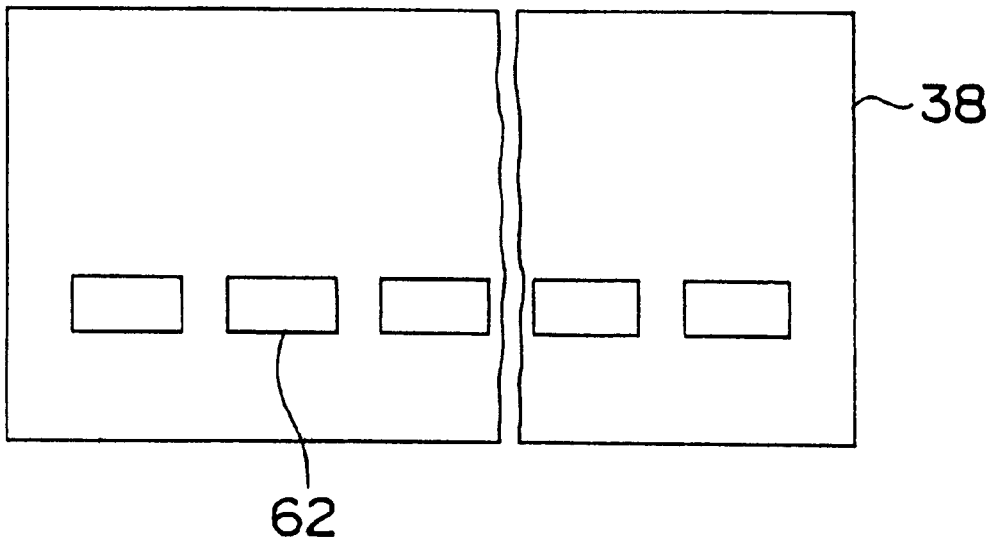
FIG. 4A is a cut-away side elevational view of an erasing sheet of another embodiment.
Figure 4B:
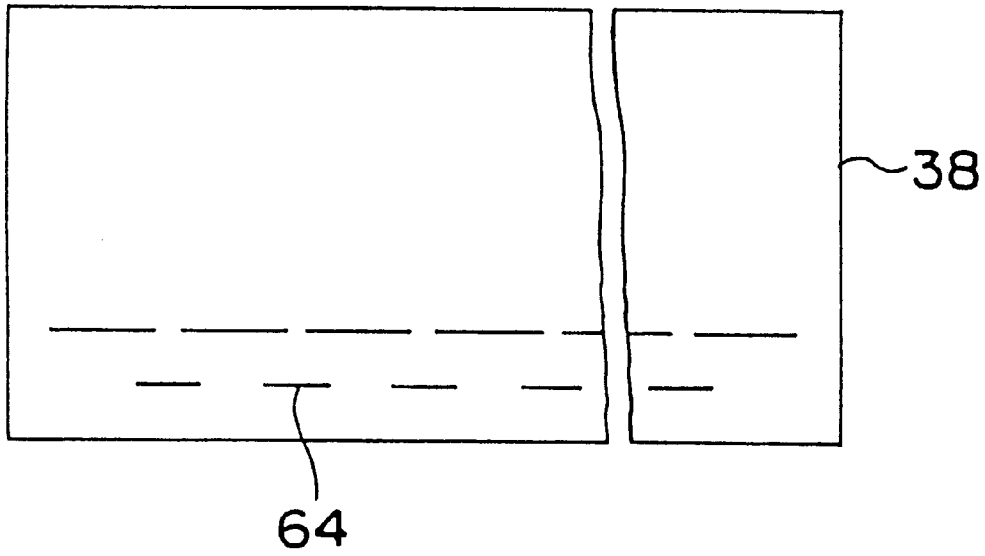
FIG. 4B is also a cut-away side elevational view of the erasing sheet of another embodiment.

To prevent ozone from remaining in the vicinity of the erasing sheet 38, as best shown in FIGS. 4A and 4B, a plurality of openings 62 or slots 64 may be formed in the erasing sheet 38. This improves the flexibility of the erasing sheet 38, allowing the erasing sheet 38 to make a close contact with the photosensitive drum 10 and therefore providing the erasing sheet 38 with a higher erasing performance. Further, this decreases a contact pressure of the erasing sheet 38 against the photosensitive drum 10.

Accordingly, a thicker erasing sheet can be employed in the eraser 14. Also, even smaller erasing sheet will ensure a required erasing performance. This allows the eraser to be smaller in size and then to be designed free from size restriction.

Figure 5:
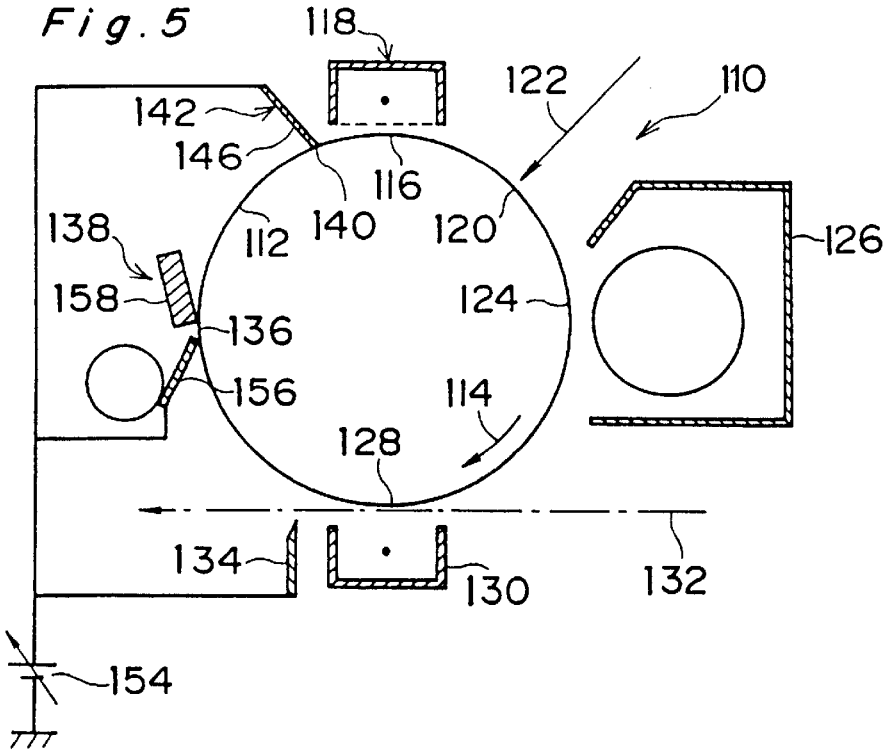
FIG. 5 is a partial cross-sectional side elevational view of the image forming apparatus which shows a major portion including a photosensitive drum.

An embodiment of the second aspect of the present invention will be described hereinafter. FIG. 5 shows elements of an electrophotographic image forming device generally indicated by reference numeral 110. The image forming device 110 includes a photosensitive drum 112 having a diameter of about 40 mm or less. In operation, the photosensitive drum 112 is rotated by the rotation of a motor (not shown) in the direction indicated by reference numeral 114 and then charged to a certain voltage at a charging station 116 by a charger 118.

The charged portion of the photosensitive drum 112 is then exposed at an exposure station 120 to an image light 122, forming an electrostatic image that corresponds to the image light. The electrostatic latent image is then visualized into a toner powder image at a developing station 124 by a developer 126. Subsequently, at a transfer station 128, the toner powder image is transferred onto a sheet, e.g., plain paper, advancing in the direction indicated by a chain line 132 by a corona charger 130 which confronts to the photosensitive drum 112.

The sheet that has moved past the transfer station 128 is separated from the photosensitive drum 112 by the discharge of an electrode 134 and is then transported to the fusing station (not shown) where the toner powder image is fused thereon. Finally, the sheet is discharged onto a catch tray (not shown).

Each of the incremental surface portions of the photosensitive drum 112 is transported to a cleaning station 136 where residual toner particles remaining on the photosensitive drum 112 are removed therefrom. Then, the residual charge on the photosensitive drum 112 is erased therefrom by an eraser 142 in preparation for the subsequent charging.

Figure 6A:
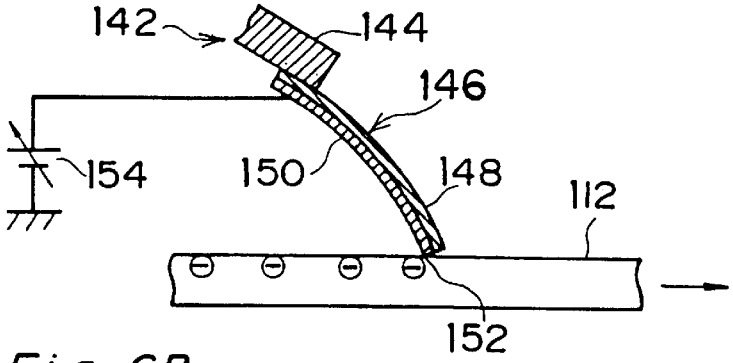
FIG. 6A is an enlarged cross-sectional view of the erasing device in which the erasing sheet has two layers.

FIG. 6A shows the eraser 142 in detail. The eraser 142 includes a support 144 and an erasing sheet 146, both extending in the axial direction of the photosensitive drum 112. The support 144 is fixedly disposed near the photosensitive drum 112 with leaving a small gap therefrom. The erasing sheet 146 is supported at one longitudinal end thereof on the support 144 and kept in contact at the other longitudinal end thereof with the outer surface of the photosensitive drum 112.

Preferably, the erasing sheet 146 has two layers, i.e., a base sheet 148 (first layer) which is made of polyethylene and a film 150 (second layer) which is made of polyester containing carbon and coated on one major surface of the base sheet 148. Advantageously, the film 150 has an electric resistance of about $10^{-3}$ to $10^{9}$ ohm-cm. Preferably and advantageously, the erasing sheet 146 has a total thickness of about 0.03 to 1.0 mm.

The coating film 150 of polyester tends to shrink after it has been coated on the base sheet 148 so that the resultant erasing sheet 146 is curved or arched as the base sheet 148 defines a convex surface portion while the coating film 150 defines a concave surface portion. The curved erasing sheet 146 is fixed at one proximal longitudinal end on the support 144 using suitable means such as adhesive while the coated film 150 which defines the concave surface portion is directed to the photosensitive drum 112. With this arrangement, the other distal longitudinal edge 152 of the coating film 150 forms a linear contact with the outer surface of the photosensitive drum 112. Preferably, the distal end portion of the erasing sheet 146 forms an angle of about 45 to 90 degrees relative to the outer surface of the photosensitive drum 112. Also, an AC power source is connected with the coating film 150 so as to apply the coating film 150 with a certain voltage. The voltage has a polarity that is different from that of the electric charge that the photosensitive drum 112 bears during the above-described image forming process.

With the erasing device 142 so constructed, applying a voltage by the power source 154 causes the contact portion of the erasing sheet 146 to erase the whole residual electric charge on the photosensitive drum 112. This ensures the outer peripheral surface of the photosensitive drum 112 to be evenly charged at the charging station 116.

In addition, the erasing sheet 146 has a plurality of layers of difference materials and thereby curved so that the coated film 150 defines a concave surface portion and the base sheet 148 defines a convex surface portion. Also, the erasing sheet 146 is disposed so that the concave surface portion faces the photosensitive drum 112. This will keep the original curvature of the erasing sheet 146 after a long use thereof, allowing the longitudinal edge 152 of conductive film 150 to keep in close contact with the photosensitive drum 112 over a long time. This in turn ensures that all of the residual charge on the photosensitive drum will be erased.

It is to be understood that the material of the erasing sheet may be other than described without departing from the scope of the present invention. For example, base sheet of the erasing sheet may be made of materials such as urethane, polyester, polyethylene, nylon, polytetrafluoroethylene and polyimide. The material of the coating film may be selected in combination of the selected material of the base sheet so that the erasing sheet will curve to render the concave surface portions confront the photosensitive drum 112.

Figure 6B:
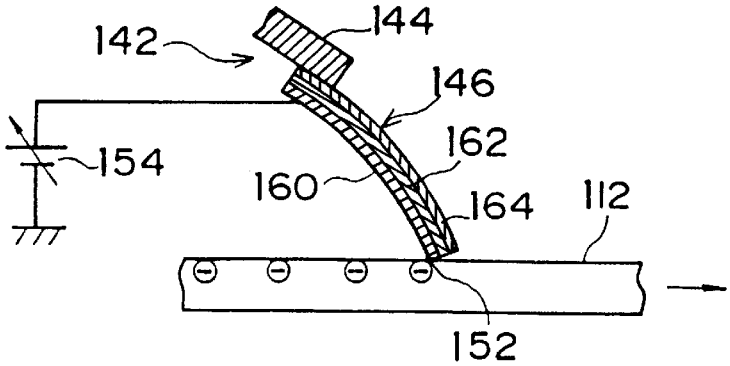
FIG. 6B is an enlarged cross-sectional view of the erasing device in which the erasing sheet has three layers.

Although the erasing sheet has two layers, as shown in FIG. 6B, it may have three layers 160, 162, and 164 or more. In this instance, at least the outermost layer that confronts to contact at its longitudinal edge with the photosensitive drum 112 should be a conductive layer.

The base sheets 150 and 162 may be a metal film. In this instance, the base sheet may be applied at one major surface with a suitable resin or at both major surfaces thereof with respective resins having different shrinkage coefficients or having different thicknesses so as to curve the erasing sheet.

The erasing sheet may be constructed by bonding a plurality of metal or resin sheet in tight contact. In this instance, the erasing sheet may be curved by firstly stretching the first film to be disposed adjacent to the photosensitive drum in one direction and secondly bonding the second film on the surface of the first film away from the photosensitive drum. In case that the base sheet is sandwiched between two films, these films may be bonded using adhesives having different shrinkage coefficients so as to provide the erasing sheet with a certain curvature.

Using a plurality of metal or resin sheets that have respective temperature coefficients may curve the erasing sheet. In this instance, for example, the sheets are bonded together at a temperature that is different from an environmental temperature at which the erasing sheet will be used, thereby the bonded erasing sheet will curve at use.

The residual charge on the photosensitive drum 112 may be pre-erased in part before the primary erasing by the eraser 142. In this instance, another erasing sheet 156 having substantially the same construction as the erasing 146 is provided at the cleaning unit 138 so that the longitudinal edge of the erasing sheet 156 contacts closely with the outer periphery of the photosensitive drum 112. Also, the erasing sheet 156 is electrically connected with the power source 154. This allows the erasing sheet 156 to erase some residual charge on the photosensitive drum 112 in the cleaning station 136. With this arrangement, the residual toner particle will lose an electric charge thereof by the contact with the erasing sheet 156, allowing the cleaning device 138 to effectively collect the residual toner particles from the photosensitive drum 112. Further, preferably the erasing sheet 156 is arranged under a toner scraping member or blade 158. This allows the toner-scraping member 158 to capture the toner particles which falls from the photosensitive drum 112 and then to lead the captured toner particles into an interior of the cleaning unit 138.

The electrode 134 for paper separation may also be connected with the power source 154 with which the erasing sheets 146 and 156 are connected. This allows the power source 154 to provide erasing sheets 146, 156 and electrode 134 with respective voltages.

Figure 7:
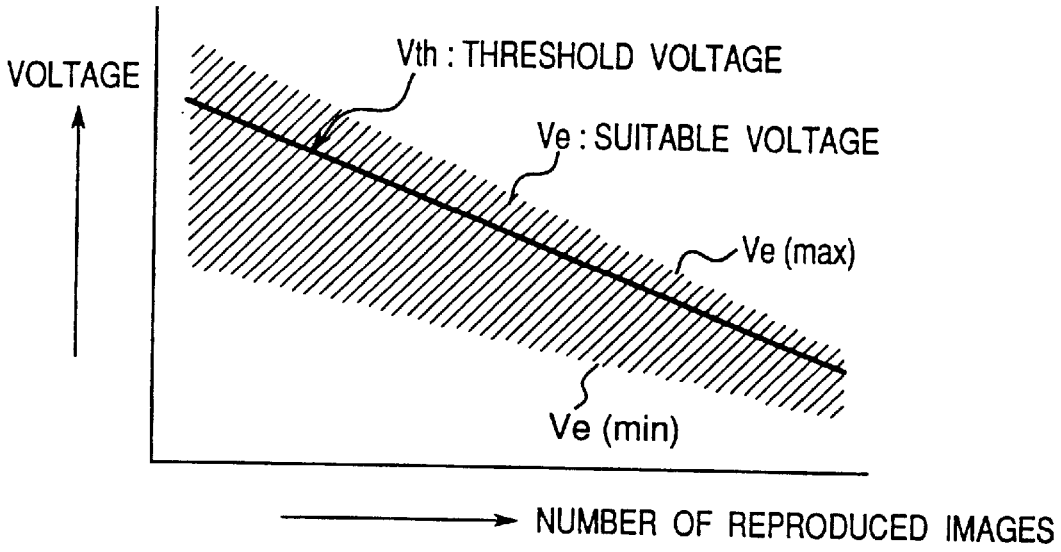
FIG. 7 is a graph which shows a characteristic of a voltage difference that occurs a discharge between the erasing sheet and the photosensitive drum versus a voltage applied to the erasing sheet and the number of images reproduced by the image forming apparatus.

Descriptions will be made to the voltage Ve to be applied to the erasing sheet. As shown in FIG. 7, a voltage difference that triggers an electric discharge between the easing sheet and the photosensitive drum tends to decrease in keeping with a deterioration of the photosensitive drum. Also, the deterioration of the photosensitive drum has an intimate relationship with the number of sheets or papers to which the images have been reproduced using the same photosensitive drum. Therefore, in this embodiment of the present invention, the voltage applied to the erasing sheet is designed to decrease within a suitable voltage range for erasing as the number of reproduced images using the one photosensitive drum increases. It should be noted that the erasing voltage might be decreased linearly or step-by-step with the increase of the number of reproduced images.

Based upon several experiments performed by the inventors, it was determined that the erasing voltage should satisfy the following relationship:

$$0.5|Vth| \leqq Ve \leqq 1.2|Vth|$$

wherein Vth represents a threshold voltage difference that triggers the electric discharge between the erasing sheet and the photosensitive drum so that the surface voltage of the photosensitive drum is reduced to absolute zero volt.

The maximum erasing voltage Ve of 1.2Vth, i.e., Ve(max) is determined whether an erasing memory (negative memory) appears on the photosensitive drum after erasing thereof. Specifically, experiments showed that applying the erasing sheet with the voltage that is more than 1.2 times of the threshold voltage difference Vth results in the erasing memory of electric charge on the photosensitive drum.

The minimum erasing voltage 0.5 Vth is determined whetter the erased photosensitive drum bears erasing defects that linearly extend along the peripheral direction thereof and erasing memory (positive memory) thereon.

The experiments showed that applying the voltage Ve of 200 volts tends to provide a new photosensitive drum with the erasing defects and positive memory. Also, as shown in the following Table 1, increasing the erasing voltage Ve has reduced the occurrence of the erasing memory and no positive memory appeared when the erasing voltage Ve is equal to or more than 0.5Vth. Therefore, it can be understood that the minimum voltage Ve (min) should be half of the threshold voltage Vth or more.

TABLE 1

| Ve | Drum I (Vth: 600 volts) | | | Drum II (Vth: 500 volts) | | |
|---|---|---|---|---|---|---|
| (vol ts) | Positive Memory | Erasing Defects | Negative Memory | Positive Memory | Erasing Defects | Negative Memory |
| 0 | A | A | C | A | A | C |
| 100 | A | A | C | A | A | C |
| 200 | A | B | C | B | B | C |
| 300 | B | B | C | C | C | C |
| 400 | C | C | C | C | C | C |
| 500 | C | C | C | C | C | C |
| 600 | C | C | C | C | C | C |
| 700 | C | C | C | C | C | A |
| 800 | C | C | A | C | C | A |

In Table 1, "Drum I" is a photosensitive drum which has been just installed and has not been used for many lots image forming operations while "Drum II" is a photosensitive drum which has been used for thousands of image forming operations and has almost reached the end of its life. Also, reference "A" means that noises were found in the reproduced images, reference "B" means that some noises were found in the reproduced images but there was no practical problem for the resultant images, and reference "C" means that no noise was found in the images.

When the photosensitive drum is charged negatively, the voltage to be applied to the erasing sheet can be determined in accordance with the number of reproduced images using one photosensitive drum from the following equation:

$$Ve = Vth\ (-1.2 + 0.000001 \cdot n)$$

wherein n represents the number of reproduced images using one photosensitive drum.

From this equation, if the threshold voltage difference is −600 volts, +720 volts will be applied to the erasing sheet when a new photosensitive drum has been just installed, i.e., n is zero, and +540 volts when 30,000 images has been reproduced using the photosensitive drum.

In the previous embodiment, the deterioration of the photosensitive drum is determined on the basis of the number of sheets or papers onto which the images are reproduced. The deterioration can be determined using the surface voltage of the photosensitive drum that has just moved past the transfer region because the surface voltage after transfer tends to decrease as the photosensitive drum deteriorates. In this case, the surface voltage of the photosensitive drum is detected after it has moved past the transfer station and the voltage to be applied to the erasing sheet is determined by the detected voltage.

In case of reproducing an image that is smaller in size than an original document, an area on the photosensitive drum to be exposed to the image light is smaller than that at forming the same size image as the original document. Therefore, at forming a smaller size image than the original document, there always exists another area that is not exposed to the image light and thereby keeps the voltage initially charged. The erasing sheet 146 needs to erase the electric charge in such non-exposed area. For this reason, at reproducing the smaller size image than the original document, a time for applying the erasing sheet 146 with the voltage is determined so that the residual charge on the non-exposed area can be erased.

Figure 8:
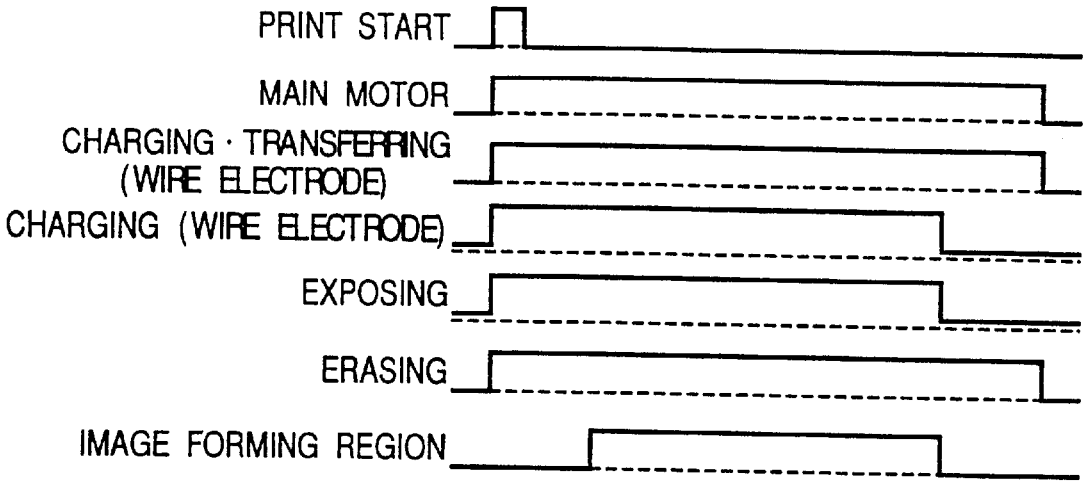
FIG. 8 is a flowchart in which the photosensitive drum is pre-rotated and during such pre-rotation the photosensitive drum is electrically charged, exposed to light and electrically erased.
Figure 9:
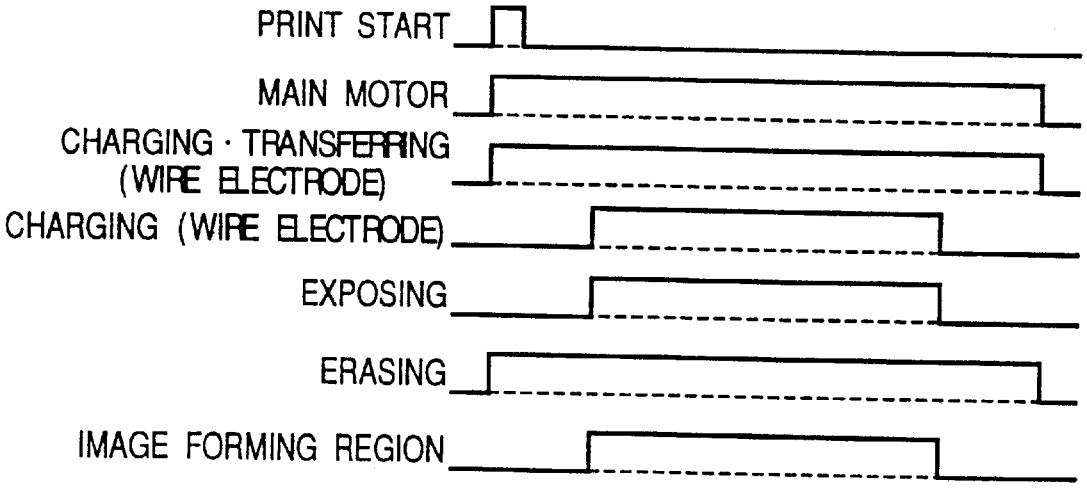
FIG. 9 is another flowchart in which the photosensitive drum is electrically charged, exposed to light and then electrically erased without being pre-rotated.

Preferably, as shown in FIG. 8, before starting the image forming process, the photosensitive drum is pre-rotated at least one revolution so that the peripheral surface of the photosensitive drum is charged, exposed to the light and then erased during such pre-rotation. Due to this, the whole residual charge on outer peripheral surface of the photosensitive drum provided during the previous image forming process can be removed. This also allows the erasing sheet to remove the residual electric charge that exists in the lowermost portion of the photosensitive drum away from the erasing sheet. For reference, FIG. 9 shows a flowchart of the image forming process in which no pre-rotation is provided with the photosensitive drum and only the image forming area of photosensitive drum is charged and then exposed.

Figure 10:
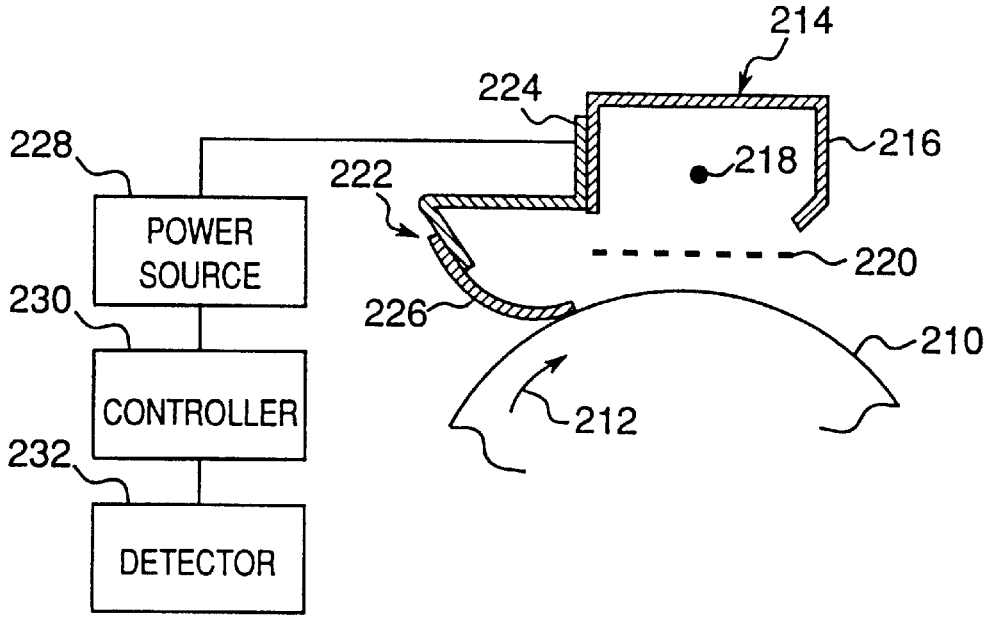
FIG. 10 is a cross-sectional view of another erasing device of the present invention.

With reference to the drawings, discussions will be made to the third embodiment of the present invention. FIG. 10 shows in part an electrophotographic image forming apparatus in which an image bearing member or photosensitive drum 210 is provided at an outer periphery thereof with a photosensitive layer and supported for rotation in the direction indicated by reference numeral 212.

An electric charger 214 includes a holder 216. The holder 216 has a cross-section in the form of bracket and an opening that confronts to the photosensitive drum 210. The charger 214 further includes a discharge electrode 218 disposed within the holder 216 and a grid 220 arranged at the opening of the holder 216. The discharge electrode 218 and the grid 220 are electrically connected with a power source so that certain voltages are applied thereto.

An eraser 222 has a frame 224 and an erasing sheet 226. The frame 224, which is made of electrically conductive material, is releasably supported by the holder 216. The erasing sheet 226, which is made of electrically conductive metal or resin and preferably having an electric resistance of $10^2$–$10^8$ ohm-cm, is supported by and electrically connected with the frame 224 while a free end thereof is in contact with the outer peripheral surface of the photosensitive drum 210. Examples of the resin include urethane, acrylic acid and nylon. The frame 224 is electrically connected with an AC power source 228, which in turn communicated with a controller 230 so that the controller 230 controls the output voltage of the power source 228. The controller 230 is further communicated with a detector 232 for detecting deterioration or the number of reproduced images.

Preferably, the erasing sheet 226 is arranged to form an angle of about 30 to 120 degrees with a tangent line of photosensitive drum that runs across a contact portion of the photosensitive drum and the erasing sheet.

Also, preferably, a displacement of the tip portion of the erasing sheet 226 due to the contact with the photosensitive drum is about 0.2 to 1.0 mm.

Various techniques are available for detecting the deterioration of the photosensitive drum 210 using any parameter that increases or decreases with the deterioration. Examples of the parameter are a total number of images reproduced for one photosensitive drum, a total number and a total time of rotations of the photosensitive drum, and an amount of toner used in the image forming processes for one photosensitive drum.

With this image forming apparatus, in the image forming operation, the detector 232 for detecting the deterioration of the photosensitive drum 210 provides the controller 230 with information of the deterioration of photosensitive drum 210. The controller 230 controls the output voltage of the power source 228 in response to the deterioration. This allows the controlled voltage to be applied through the frame 224 to the erasing sheet 226. Due to this, the residual charge that remains on the photosensitive drum 210 after transfer can be erased. Subsequently, each of the incremental portions of the photosensitive drum is charged again by the charger 214 in preparation for the next image forming.

Figure 11:
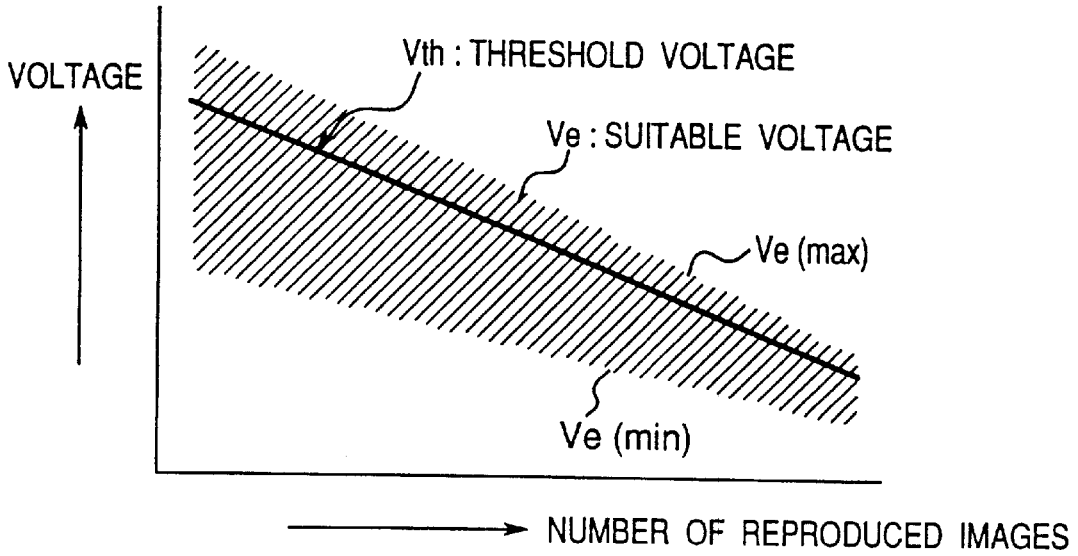
FIG. 11 is a graph which shows a characteristic of a voltage difference that occurs a discharge between the erasing sheet and the photosensitive drum versus a voltage applied to the erasing sheet and the number of images reproduced by the image forming apparatus.

It can be understood that the erasing is a sort of discharging phenomenon and then the erasing begins when a difference of between a voltage of a surface portion of the photosensitive drum that has reached the erasing region and a voltage Ve applied to the erasing member just exceeds a certain threshold voltage. In this embodiment, according to Paschen's rule, the threshold voltage difference Vth that gives rise to the erasing effect is about 600 volts if the photosensitive drum is just installed and about 500 volts if the photosensitive drum has reached almost the end of its life. FIG. 11 shows that the threshold voltage Vth decreases as the photosensitive drum deteriorates.

Discussions will be made to the erasing voltage Ve that is applied to the erasing sheet 226. As shown in FIG. 11, the threshold voltage difference tends to decrease in proportion to the number of image formation and therefore the controller 230 decreases the voltage applied to the erasing sheet 226 in response to the output of the detector 232, i.e., deterioration of the photosensitive drum provided that the voltage is within a predetermined suitable voltage range. It is to be understood that the voltage may be decreased linearly or step-by-step according to the number of image formation.

Experiments performed by the inventors has determined that a suitable voltage of the erasing voltage Ve should satisfy the following equation:

$$0.5|Vth| \leqq Ve \leqq 1.2|Vth|$$

The maximum erasing voltage Ve of 1.2Vth, i.e., Ve(max) is determined whether an erasing memory (negative memory) appears on the photosensitive drum after erasing thereof. Specifically, experiments showed that applying the erasing sheet with the voltage that is more than 1.2 times of the threshold voltage difference Vth results in the erasing memory of electric charge on the photosensitive drum.

The minimum erasing voltage 0.5 Vth is determined whether the erased photosensitive drum bears erasing defects that linearly extend along the peripheral direction thereof and erasing memory (positive memory) thereon.

The experiments showed that applying the voltage Ve of 200 volts tends to provide a new photosensitive drum with the erasing defects and positive memory. Also, as shown in the following Table 2, increasing the erasing voltage Ve has reduced the occurrence of the erasing memory and no positive memory was appeared when the erasing voltage Ve is equal to or more than 0.5Vth. Therefore, it can be understood that the minimum voltage Ve (min) should be half of the threshold voltage Vth or more.

TABLE 2

| Ve | Drum I (Vth: 600 volts) | | | Drum II (Vth: 600 volts) | | |
|---|---|---|---|---|---|---|
| (volts) | Positive Memory | Erasing Defects | Negative Memory | Positive Memory | Erasing Defects | Negative Memory |
| 0 | A | A | C | A | A | C |
| 100 | A | A | C | A | A | C |
| 200 | A | B | C | B | B | C |
| 300 | B | B | C | C | C | C |
| 400 | C | C | C | C | C | C |
| 500 | C | C | C | C | C | C |
| 600 | C | C | C | C | C | C |
| 700 | C | C | C | C | C | A |
| 800 | C | C | A | C | C | A |

In Table 2, "Drum I" is a photosensitive drum which has been just installed and has not been used for many image forming operations while "Drum II" is a photosensitive drum which has been used for thousands of image forming operations and has almost reached the end of its life. Also, reference "A" means that noises were found in the reproduced images, reference "B" means that some noises were found in the reproduced images but there was no practical problem for the resultant images, and reference "C" means that no noise was found in the images.

When the photosensitive drum is charged negatively, the voltage to be applied to the erasing sheet can be determined in accordance with the number of reproduced images using one photosensitive drum from the following equation:

$$Ve = Vth\ (-1.2 + 0.000001 \cdot n)$$

wherein n represents the number of reproduced images using one photosensitive drum.

From this equation, if the threshold voltage difference is −600 volts, +720 volts will be applied to the erasing sheet when a new photosensitive drum has been just installed, i.e., n is zero, and +540 volts when 30,000 images has been reproduced using the photosensitive drum.

In the previous embodiment, the deterioration of the photosensitive drum is determined on the basis of the number of sheets or papers onto which the images are reproduced. The deterioration can be determined by the use of the surface voltage of the photosensitive drum that has just moved past the transfer region because the surface voltage after transfer tends to decrease as the photosensitive drum deteriorates. In this case, the surface voltage of the photosensitive drum is detected after it has moved past the transfer station and the voltage to be applied to the erasing sheet is determined by the detected voltage.

Also, instead of erasing sheet, another erasing members can be available. The erasing members may include a brush roll, roller and blade, mounted adjacent to the photosensitive drum in contact therewith. The voltage, if it is necessary to be applied to the brush, roller or blade, may be decreased as the number of the reproduced images is increased.

Although the present invention has been fully described by way of examples with reference to the accompanying drawings, it is to be noted that various changes and modifications will be apparent to those skills in the art. Therefore, unless otherwise such changes and modifications depart from the scope of the present invention, they should be construed as being included therein.

What is claimed is:

1. A contact-type erasing device, comprising:

a power source;

an erasing member connected to said power source and arranged in contact with an image bearing member for erasing a residual electric charge from said image bearing member, said erasing member being supported by an electric charger for charging the image bearing member.

2. A device claimed in claim 1, wherein said erasing member is supported by a supporting member which in turn is supported by said electric charger.

3. A device claimed in claim 2, wherein said supporting member is formed with an opening.

4. A device claimed in claim 1, wherein said electric charger is a corona charger.

5. A device claimed in claim 1, wherein said erasing member is formed with at least one opening to allow a gas to pass therethrough.

6. A device claimed in claim 1, wherein said erasing member is disposed on an upstream side of said electric charger with respect to a direction along which said image bearing member moves.

7. A device claimed in claim 1, wherein said erasing member is a conductive flexible sheet in the form of a strip.

8. A contact-type erasing device, comprising:

a power source;

an erasing member connected to said power source and arranged in contact with an image bearing member for erasing a residual electric charge on said image bearing member, said erasing member including a first layer made of an electrically conductive material and a second layer located on one major surface of said first layer, and said erasing member being arranged so that said first layer is in contact with said image bearing member.

9. A device claimed in claim 8, wherein said erasing member is in the form of arch having a concave surface portion on one side and a convex surface portion on the opposite side, said concave surface portion is formed by said first layer.

10. A device claimed in claim 9, wherein a longitudinal edge of said first layer is in contact with said image bearing member.

11. A device claimed in claim 10, wherein said erasing member is arranged on an upstream side and a downstream side of a cleaning member with respect to a direction along which said image bearing member moves.

12. A device claimed in claim 8, wherein said first layer is applied with a voltage, said voltage being about 0.5 to 1.2 times greater than a threshold voltage that causes an electric discharge between said first layer and said image bearing member.

13. A device claimed in claim 8, wherein said erasing member has a thickness of about 0.03 to 1.0 mm.

14. A device claimed in claim 8, wherein said first layer forms an angle of about 45 to 90 degrees relative to said image bearing member.

15. A device claimed in claim 8, wherein said first layer has an electric resistance of about $10^{-3}$ to $10^{-9}$ ohm-cm.

16. A device claimed in claim 8, wherein said erasing member is a conductive flexible sheet in the form of a strip.

17. A device claimed in claim 8, wherein said erasing member includes three or more layers.

18. A contact-type erasing device for erasing a residual electric charge on an image bearing member, comprising:

an erasing member which is in contact with said image bearing member for erasing said residual electric charge on said image bearing member;

a voltage applying member which applies said erasing member with a voltage; and a controller for controlling said voltage in response to a deterioration of said image bearing member, wherein said voltage applied to said erasing member is 0.5 to 1.2 times greater than a threshold voltage that triggers an electric discharge between said erasing member and said image bearing member.

19. A device claimed in claim 18, wherein said erasing member is in the form of plain sheet.

20. A device claimed in claim 18, wherein said deterioration is determined on the basis of number of papers used for forming images.

21. A device claimed in claim 18, wherein said deterioration is determined on the basis of a surface voltage of the image bearing member.

22. A device claimed in claim 21, wherein said surface voltage is detected after images formed on the image bearing member are transferred.

23. A contact-type erasing device, comprising:

a power source;

an erasing member connected to said power source and arranged in contact with an image bearing member for erasing a residual electric charge from said image bearing member, said erasing member being supported by an electric charger for charging the image bearing member, wherein said erasing member is formed with at least one opening to allow a gas to pass therethrough.

24. A contact-type erasing device, comprising:

a power source;

a sheet-like erasing member connected to said power source and arranged in contact with an image bearing member for erasing a residual electric charge on said image bearing member, said erasing member including a first layer made of an electrically conductive material and a second layer located on one major surface of said first layer, and said erasing member being arranged so that said first layer is in contact with said image bearing member, wherein said first layer is applied with a voltage, said voltage being 0.5 to 1.2 times greater than a threshold voltage that causes an electric discharge between said first layer and said image bearing member.

25. A contact-type erasing device, comprising:

an erasing member which is in contact with said image bearing member for erasing said residual electric charge on said image bearing member;

a voltage applying member which applies said erasing member with a voltage; and a controller for controlling said voltage which decreases in response to a deterioration of said image bearing member.

* * * * *